US008054271B2

(12) United States Patent
Pan et al.

(10) Patent No.: US 8,054,271 B2
(45) Date of Patent: Nov. 8, 2011

(54) METHOD OF DRIVING A PIXEL AND LIQUID CRYSTAL DISPLAY PANEL IMPLEMENTING THE METHOD

(75) Inventors: Hsuan-Lin Pan, Taoyuan County (TW); Po-Sheng Shih, Taoyuan County (TW)

(73) Assignee: Hannstar Display Corp., Tao-Yuan Hsien (TW)

( * ) Notice: Subject to any disclaimer, the term of this patent is extended or adjusted under 35 U.S.C. 154(b) by 929 days.

(21) Appl. No.: 11/764,269

(22) Filed: Jun. 18, 2007

(65) Prior Publication Data

US 2008/0272990 A1 Nov. 6, 2008

(30) Foreign Application Priority Data

May 3, 2007 (TW) ..... 96115705 A

(51) Int. Cl.
*G09G 3/36* (2006.01)

(52) U.S. Cl. ..... 345/94; 345/87; 345/208; 345/211; 345/690; 345/89

(58) Field of Classification Search ..... 345/87–104, 345/204–215, 690–699
See application file for complete search history.

(56) References Cited

U.S. PATENT DOCUMENTS 7,145,535 B2 * 12/2006 Takako et al. ..... 345/87
2002/0171640 A1 * 11/2002 Bu et al. ..... 345/208

* cited by examiner

*Primary Examiner* — Lun-Yi Lao
*Assistant Examiner* — Kelly B Hegarty
(74) *Attorney, Agent, or Firm* — Thomas, Kayden, Horstemeyer & Risley, LLP

(57) ABSTRACT

The invention provides methods of driving a pixel and liquid crystal display panels implementing the methods. The invention generates an ideal data voltage corresponding to a gray level of the pixel, and generates a compensated data voltage corresponding to the gray level according to a polarity change of the pixel. The charging period of the pixel is divided into a first charging time segment and a second charging time segment. The invention charges the pixel by the compensated data voltage during the first charging time segment, and charges the pixel by the compensated data voltage during the second charging time segment.

21 Claims, 7 Drawing Sheets

METHOD OF DRIVING A PIXEL AND LIQUID CRYSTAL DISPLAY PANEL IMPLEMENTING THE METHOD

BACKGROUND OF THE INVENTION

1. Field of the Invention

The invention relates to liquid crystal display panels, and more particularly relates to a method of driving a pixel and a liquid crystal display panel implementing the method.

2. Description of the Related Art

Conventional liquid crystal display panels employ a scanning frequency of about 60 Hz. Although a scanning frequency of 60 Hz is largely adequate, it is too slow for dynamic images and often results in image smear. To prevent image smear, one solution for preventing image smear is to increase the scanning frequency, for example, 120 Hz.

In a 120 Hz monitor, a frame displayed in a 60 Hz monitor is processed and divided into two sub-frames. For a pixel, the sum of the generated brightness in the two sub-frames is equal to the brightness generated in the original frame, but in another embodiment, the two sub-frames may have different brightness.

Although the increased scanning frequency can reduce image smear in dynamic images, it also reduces the charge/discharge period, and the voltage level of the pixel may not be capable of achieving the required data voltage. FIGS. 1A and 1B show voltage waveforms of a pixel of a 60 Hz monitor being charged, and voltage waveforms of a pixel of a 120 Hz monitor being charged. $V_{com}$ represents the voltage level of a common electrode. Pixels are enabled/disabled by their corresponding gate voltages $V_{gate}$. When a pixel is enabled by its gate voltage $V_{gate}$, a data voltage $V_{data}$ begins charging the pixel. Pixel voltage $V_{pixel}$ represents the voltage level of the pixel. Referring to FIG. 1A, after the gate voltage $V_{gate}$ enables the pixel, the pixel voltage $V_{pixel}$ begins charging to the data voltage $V_{data}$. At the end of time period T, the pixel voltage $V_{pixel}$ achieves the data voltage $V_{data}$. Referring to FIG. 1B, the amount of time for charging is T/2, half of that for conventional 60 Hz monitors, and is thus too short to charge the pixel voltage $V_{pixel}$ to the data voltage $V_{data}$. As shown in FIG. 1B, at the end of charging period, there is a voltage difference $\Delta V_{d-p}$ between the pixel voltage $V_{pixel}$ and the data voltage $V_{data}$. The voltage difference $\Delta V_{d-p}$ damages the image contact of the liquid crystal display panel. Thus, novel methods for driving a pixel capable of overcoming the described shortcomings are desirable.

BRIEF SUMMARY OF THE INVENTION

The invention provides techniques for sufficiently charging and discharging high scanning frequency monitors.

The invention provides methods of driving a pixel. The invention generates an ideal data voltage corresponding to a gray level of the pixel, and generates a compensated data voltage corresponding to the gray level according to a polarity change of the pixel. A charging period of the pixel is divided into a first charging time segment and a second charging time segment. The invention charges the pixel by the compensated data voltage during the first charging time segment, and charges the pixel by the ideal data voltage during the second charging time segment. In some embodiments, an ideal data voltage corresponding to a maximum gray level is not equal to a compensated data voltage corresponding to the maximum gray level.

The invention further provides liquid crystal display panels comprising a pixel, a timing control device, a gamma curve storage, a gamma curve selector, and a pixel driver. The timing control device generates a synchronous signal, a control signal, and a gray level for the pixel. The gamma curve storage may be implemented by a gamma curve chip or a gamma resistor. The gamma curve storage comprises an ideal gamma curve and at least one compensated gamma curve. An ideal data voltage is generated according to the ideal gamma curve. Based on the synchronous signal, the gamma curve selector selects one compensated gamma curve from the gamma curve storage during a first charging time segment according to a polarity change of the pixel, and selects the ideal gamma curve from the gamma curve storage during a second charging time segment. According to the gamma curve selected by the gamma curve selector, the control signal, and the gray level of the pixel, the pixel driver generates a data voltage to charge/discharge the pixel. In some embodiments, a data voltage corresponding to a maximum gray level generated according to the ideal gamma curve is not equal to a data voltage corresponding to the maximum gray level generated according to the compensated gamma curve.

The foregoing and other advantages will become more apparent with reference to the following description taken in conjunction with the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is made for the purpose of illustrating the general principles of the invention and should not be taken in a limiting sense. The scope of the invention is best determined by reference to the appended claims.

Figure 1A:
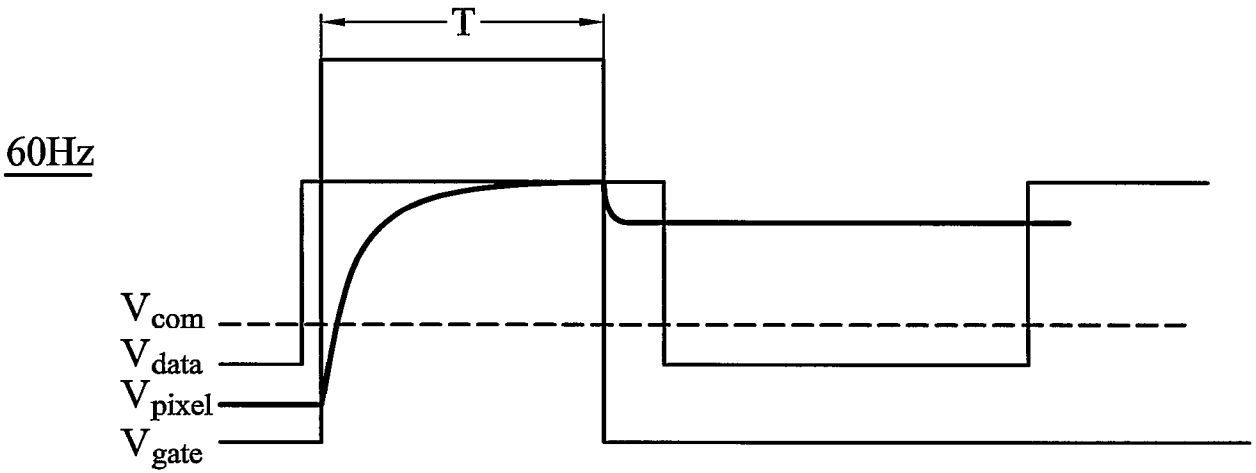
FIG. 1A (PRIOR ART)
FIG. 1A shows voltage waveforms of a pixel of a 60 Hz monitor being charged.
Figure 1B:
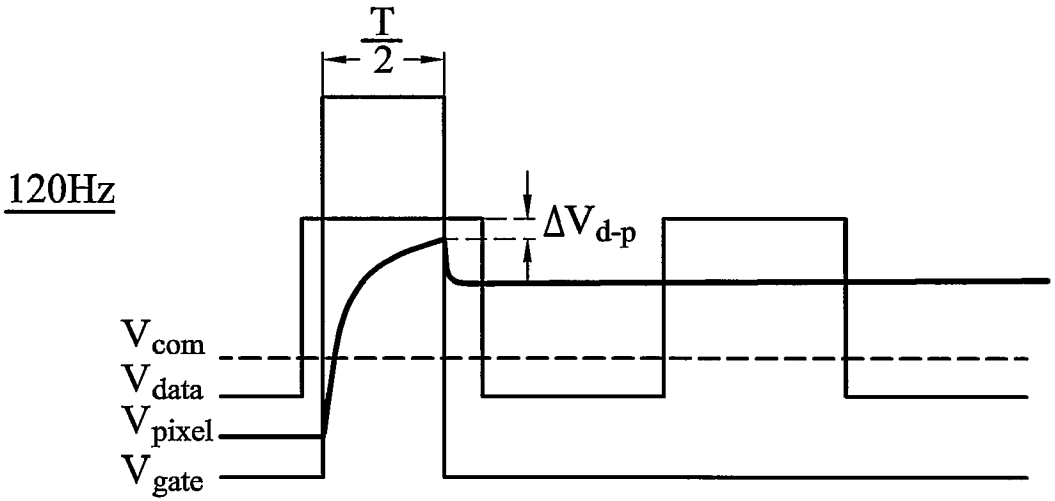
FIG. 1B (PRIOR ART)
FIG. 1B shows voltage waveforms of a pixel of a 120 Hz monitor being charged.
Figure 2B:
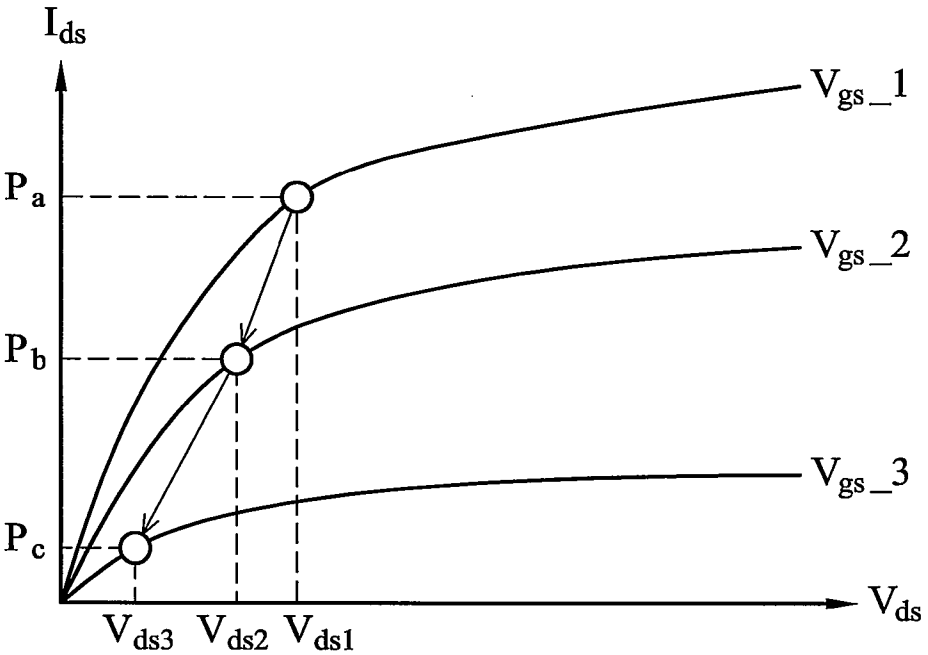
FIG. 2B (PRIOR ART)
FIG. 2B shows how $V_{gs}$ and $V_{ds}$, affect the charge current $I_{ds}$ shown in FIG. 2A.
Figure 2A:
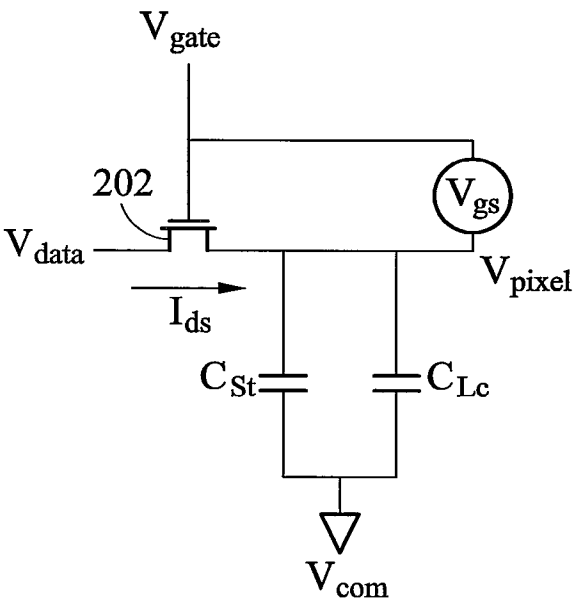
FIG. 2A (PRIOR ART)
FIG. 2A shows a simplified circuit of a pixel.

FIG. 2A shows a simplified circuit of a pixel. The pixel is enabled/disabled by a gate voltage $V_{gate}$. When the pixel is enabled, the pixel is charged/discharged to a data voltage $V_{data}$. $V_{pixel}$ represents the voltage level of the pixel, referred to as pixel voltage. In the prior art of FIG. 2A, the polarity of the pixel is positive ($V_{data}$ and $V_{pixel}$ are both greater than $V_{com}$), and the initial value of the pixel voltage $V_{pixel}$ is lower than the data voltage $V_{data}$.

FIG. 2B shows how the voltage differences between the electrodes of the transistor 202, $V_{gs}$ and $V_{ds}$, affect the charge current $I_{ds}$, wherein $V_{gs}=V_{gate}-V_{pixel}$ and $V_{ds}=V_{data}-V_{pixel}$. The data voltage $V_{data}$ and the gate voltage $V_{gate}$ are constant during the charging period. The pixel voltage $V_{pixel}$ is charged by the charge current $I_{ds}$ and rises to the data voltage $V_{data}$, thus the voltage difference between the drain and source of the transistor 202, $V_{ds}$, equaling $V_{data}$ minus $V_{pixel}$, and the voltage difference between the gate and source of the transistor 202, $V_{gs}$ equaling $V_{gate}$ minus $V_{pixel}$, drop. Referring to FIG. 2B, the voltage difference between the gate and source of the transistor 202 ($V_{gs}$) drops from $V_{gs1}$ to $V_{gs2}$ and finally to $V_{gs3}$, and the voltage difference between the drain and source of the transistor 202 ($V_{ds}$) respectively drops from $V_{ds1}$ to $V_{ds2}$ and finally to $V_{ds3}$. Correspondingly, the charge current $I_{ds}$ falls from $P_a$ to $P_b$ and finally to $P_c$. Because the charge current $I_{ds}$ drops rapidly, adequate charge is not provided to the pixel, and thus, not capable of sufficiently charging the pixel to the data voltage $V_{data}$.

Figure 3B:
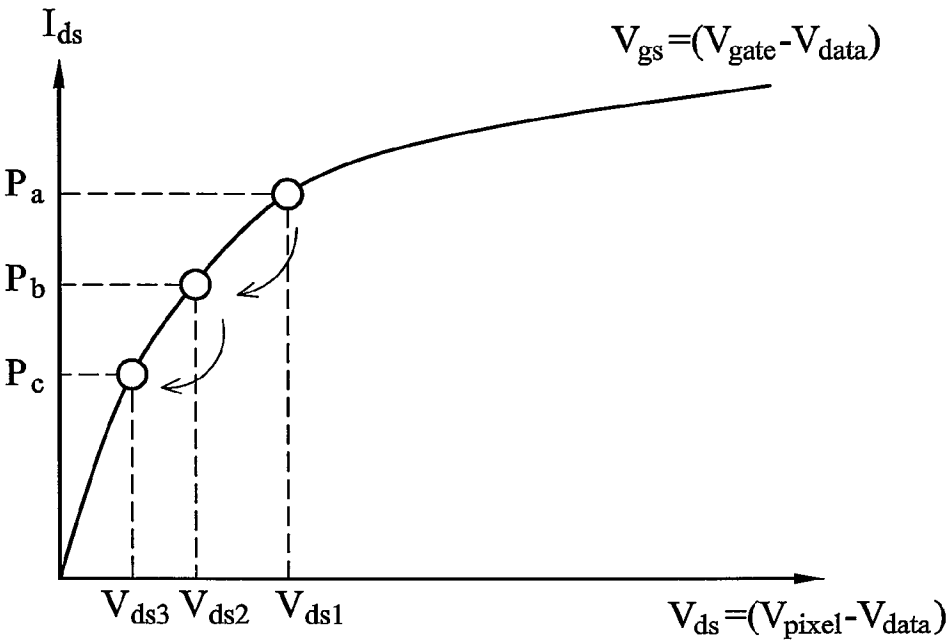
FIG. 3B (PRIOR ART)
FIG. 3B shows how $V_{gs}$ and $V_{ds}$, affect the discharge current $I_{ds}$ shown in FIG. 3A.
Figure 3A:
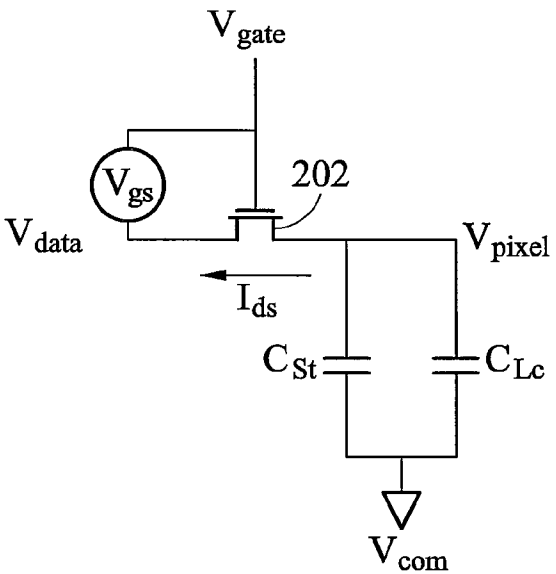
FIG. 3A (PRIOR ART)
FIG. 3A shows another simplified circuit of a pixel.

FIG. 3A shows another simplified circuit of a pixel, wherein the polarity of the pixel is negative ($V_{data}$ and $V_{pixel}$ are both lower than $V_{com}$) and the initial value of the pixel voltage $V_{pixel}$ is greater than the data voltage $V_{data}$. In this embodiment, the voltage difference between the drain and source of the transistor 202 ($V_{ds}$) equals to the voltage difference between the pixel voltage $V_{pixel}$ and the data voltage $V_{data}$, and the voltage difference between the gate and source of the transistor 202 ($V_{gs}$) equals to the voltage difference between the gate voltage $V_{gate}$ and the data voltage $V_{data}$, wherein $V_{ds}=V_{pixel}-V_{data}$ and $V_{gs}=V_{gate}-V_{data}$.

FIG. 3B shows how the voltage differences between the electrodes of the transistor 202, $V_{gs}$ and $V_{ds}$, affect the discharge current $I_{ds}$ The data voltage $V_{data}$ and the gate voltage $V_{gate}$ are constant during the discharging period, thus, the voltage difference between the gate and source of the transistor 202 ($V_{gs}$ that equals to $V_{gate}$ minus $V_{data}$) is constant. As shown in FIG. 3A, the pixel voltage $V_{pixel}$ is discharged by the discharge current $I_{ds}$ and drops to the data voltage $V_{data}$, thus the voltage difference between the drain and source of the transistor 202 ($V_{ds}$, that equals to $V_{pixel}$ minus $V_{data}$) drops gradually. Referring to FIG. 3B, the voltage difference between the gate and source of the transistor 202 ($V_{gs}$) is constant, the voltage difference between the drain and source of the transistor 202 ($V_{ds}$) drops from $V_{ds1}$ to $V_{ds2}$ and finally to $V_{ds3}$, and the discharge current $I_{ds}$ falls from $P_a$ to $P_b$ and finally, gradually to $P_c$. Compared with the rapidly dropping charge current shown in FIG. 2B, the gradually dropping discharge current shown in FIG. 3B is sufficient to discharge the pixel to the data voltage $V_{data}$. It is obvious that instances of insufficient charge/discharge typically occur in pixels with positive polarity rather negative polarity.

In addition to the previously described charge/discharge characteristics of a pixel, research, on the charge/discharge characteristics of a pixel also depend on the prior polarity of the pixel. When the polarity change of the pixel is from negative to positive, the insufficient charge/discharge is more severe than when the pixel is maintained at positive polarity. The invention also provides solutions for overcoming insufficient charge/discharge arising from changes in the polarity change of the pixel.

Figure 4:
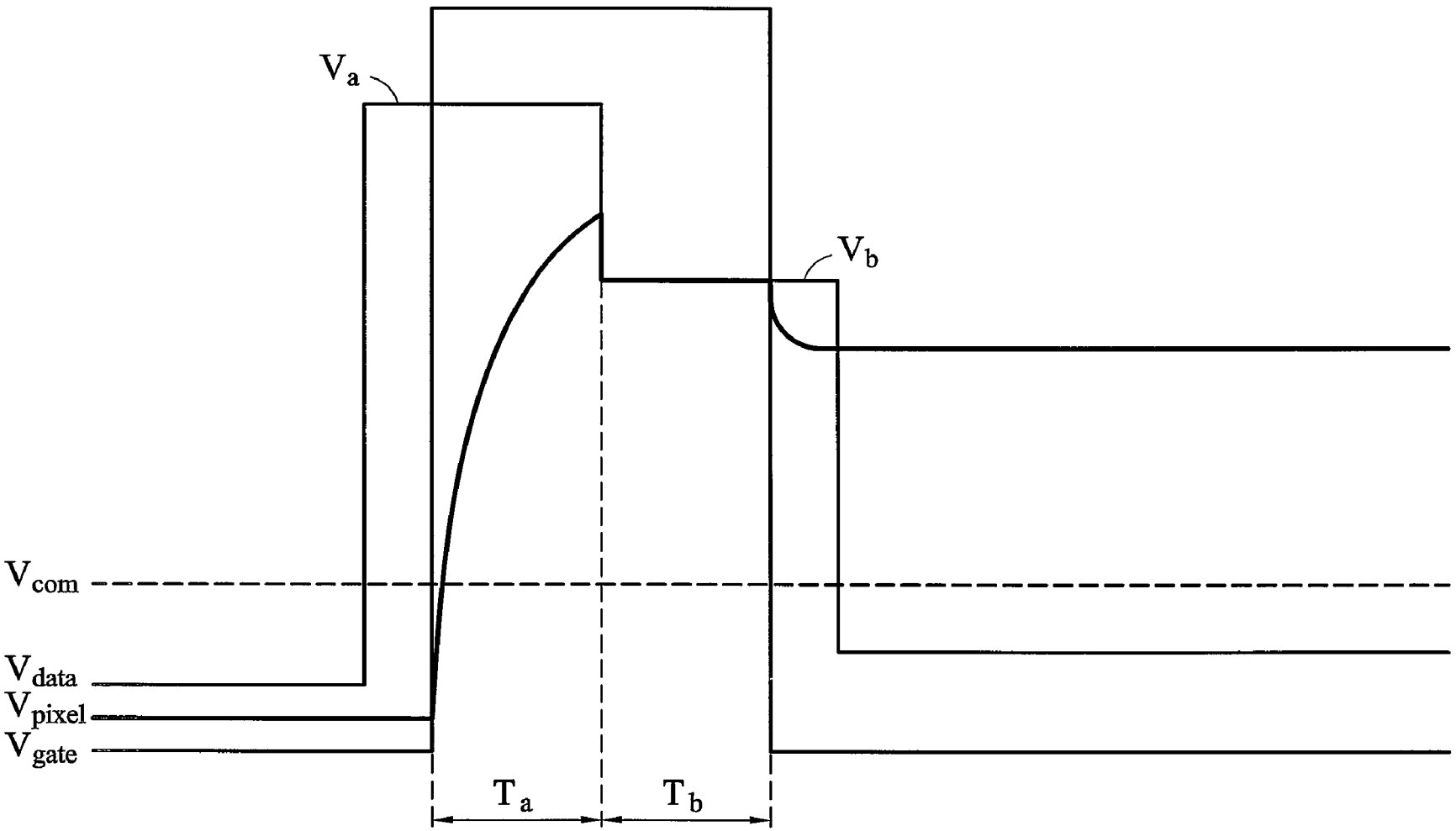
FIG. 4 shows voltage waveforms of a pixel charged, according to the invention.

FIG. 4 shows voltage waveforms of a pixel being charged, wherein our invention is applied to charging the pixel. In this example, the prior polarity of the pixel is negative (the initial values of the data voltage $V_{data}$ and the pixel voltage $V_{pixel}$ are both lower than the voltage level of a common electrode $V_{com}$), and the present polarity of the pixel is positive (the value of the data voltage $V_{data}$ and the pixel voltage $V_{pixel}$ are both greater than $V_{com}$ when the gate voltage $V_{gate}$ is high). Initially the data voltage $V_{data}$ rise to higher than $V_{com}$, but the pixel voltage $V_{pixel}$ is still lower than the data voltage $V_{data}$ because the gate voltage $V_{gate}$ is still low and the pixel is still disabled. If a conventional driving method is applied, the charge current will drop rapidly as shown in FIG. 2B. Referring to FIG. 4, our invention divides a charging period into a first charging time segment $T_a$ and a second charge current $T_b$. A data voltage $V_{data}$ corresponding to a gray level, not accounting for insufficient charge/discharge, is an ideal data voltage $V_b$. To overcome insufficient charge/discharge, the invention generates a compensated data voltage $V_a$ corresponding to the gray level. In embodiment of FIG. 4, the compensated data voltage $V_a$ is greater than the ideal data voltage $V_b$, thus ensuring the charge current is for charging the pixel is adequate. The invention charges the pixel by the compensated data voltage $V_a$ during the first charging time segment $T_a$, and charges the pixel by the ideal data voltage $V_b$ during the second charging time segment $T_b$. As shown in FIG. 4, the compensated data voltage $V_a$ greater than the ideal data voltage $V_b$ ensures the pixel voltage $V_{pixel}$ being close to the ideal data voltage $V_b$ at the end of the first charging time segment $T_a$. The pixel voltage $V_{pixel}$ is fine tuned to the ideal data voltage $V_b$ during the second charging time segment $T_b$. Compared with conventional pixel driving methods, the insufficient charge/discharge are solved by the invention.

In the example shown in FIG. 4, the liquid crystal display panel is normal black mode, here is only an example to describe the invention, but not intended to be exhaustive or to be limited to the precise form disclosed. In some cases, the invention further comprises an ideal data voltage corresponding to a maximum gray level is not equal to a compensated data voltage corresponding to the maximum gray level. Suppose the compensated data voltage corresponding to the maximum gray level is $V_{a_max}$, the ideal data voltage corresponding to the maximum gray level is $V_{b_max}$. ($V_{a_max}-V_{com}$) is greater than ($V_{b_max}-V_{com}$) in the embodiment shown in FIG. 4.

Figure 5:
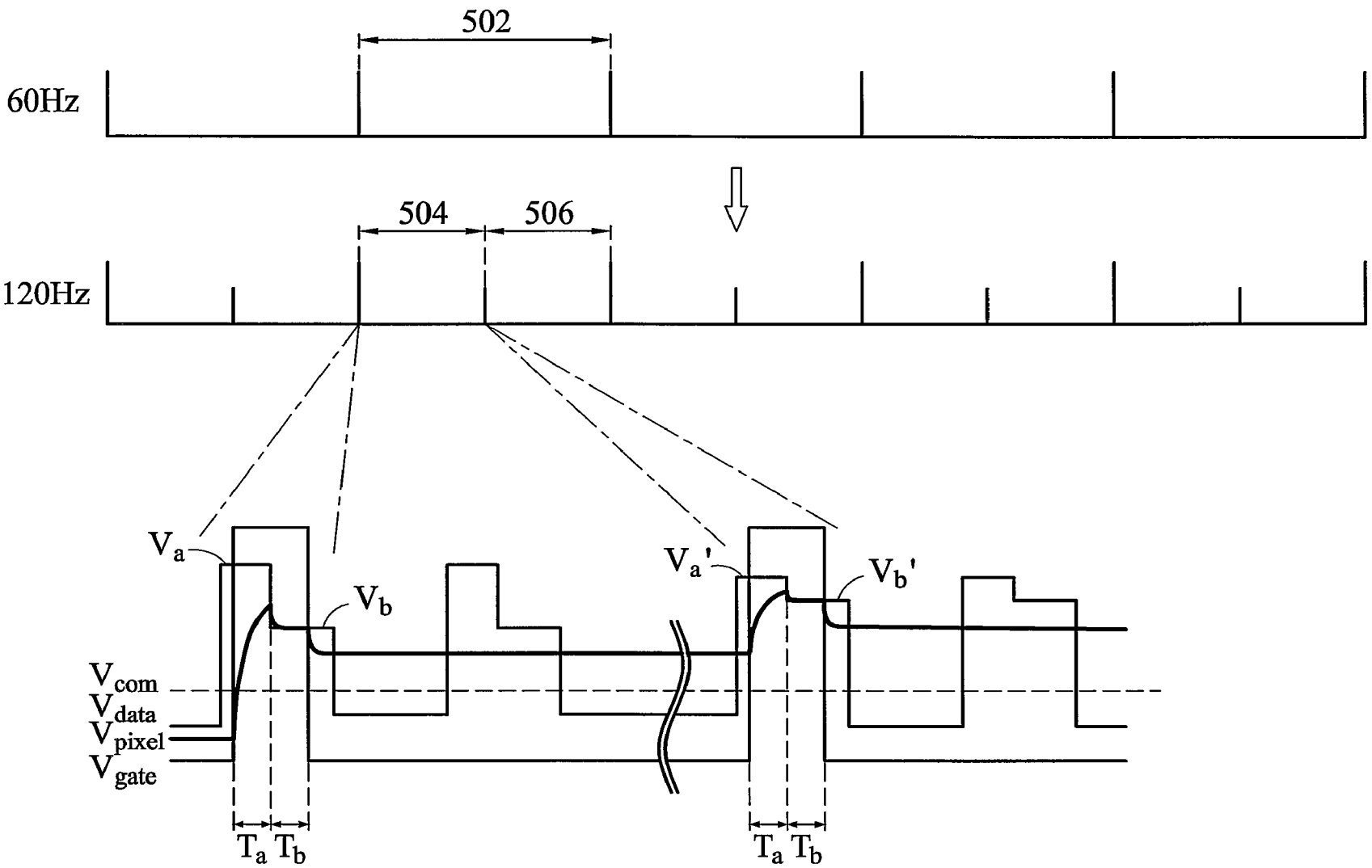
FIG. 5 shows voltage waveforms of a pixel driven by a method of the invention.

FIG. 5 shows voltage waveforms of a pixel driven by a method of the invention. In this case, the scanning frequency of the monitor is 120 Hz. The 120 Hz monitor uses two sub-frames 504 and 506 to replace one frame 502 of a 60 Hz monitor. In the sub-frame 504, the polarity change is from negative polarity ($V_{pixel}$ and $V_{data}$ are both lower than $V_{com}$) to positive polarity ($V_{pixel}$ and $V_{data}$ are both greater than $V_{com}$). In the sub-frame 506, the polarity of the pixel stays positive and does not change. Thus, insufficient charge/discharge in sub-frame 504 is more severe than in sub-frame 506. Thus, the invention provides a first compensated gamma curve and a second compensated gamma curve for sub-frames 504 and 506, respectively. The first and second compensated gamma curves individually overcome insufficient charge/discharge in sub-frames 504 and 506. Referring to FIG. 5, in the first charging time segment $T_a$ of sub-frame 504, a compensated data voltage $V_a$ is generated according to the first compensated gamma curve and utilized to charge the pixel. In the second charging time segment $T_b$ of sub-frame 504, an ideal data voltage $V_b$ is generated according to the ideal gamma curve and utilized to charge the pixel. In the first charging time segment $T_a$ of the sub-frame 506, a compensated data voltage $V_a'$ is generated according to the second compensated gamma curve and utilized to charge the pixel. In the second charging time segment $T_b$ of the sub-frame 506, an ideal data voltage $V_b'$ is generated according to the ideal gamma curve and utilized to charge the pixel. Additionally, the $V_b$ and the $V_b'$ may not to be the same or may not have any relationship.

In the example of FIG. 5, the liquid crystal display panel is in normal black mode, here is only an example to describe the invention, but not intended to be exhaustive or to be limited to the precise form disclosed. When the polarity of the pixel is positive, a first data voltage corresponding to a gray level and generated according to the first compensated gamma curve is greater than a second data voltage corresponding to the gray level and generated according to the second compensated gamma curve. Additionally, the second data voltage is greater than a third data voltage corresponding to the gray level generated according to the ideal gamma curve. Further, the maximum data voltages generated according to different gamma curves (the ideal gamma curve, or the above mentioned compensated gamma curves) are not equal.

As described with reference to FIGS. 3A and 3B, insufficient charge/discharge is rare when the polarity of the pixel is negative. Thus, when the polarity of the pixel is negative, the compensated data voltage driving a pixel during the first charging time segment is typically the same as the ideal data voltage driving the pixel during the second charging time segment. In some special cases, however, insufficient charge/discharge still occurs even though the polarity of the pixel is negative. In such cases, the invention provides individually designed compensated gamma curves for the pixel having a polarity change from positive to negative and pixels in which the polarity always negative.

In the mentioned special cases, instances of insufficient charge/discharge in a pixel always at positive polarity are as severe as in a pixel having a polarity change from negative to positive. In such cases, the second gamma curve applied to generate the compensated data voltage for the pixel maintained at positive polarity is the same as the first gamma curve applied to generate the compensated data voltage for the pixel having a polarity change from negative to positive.

Figure 6:
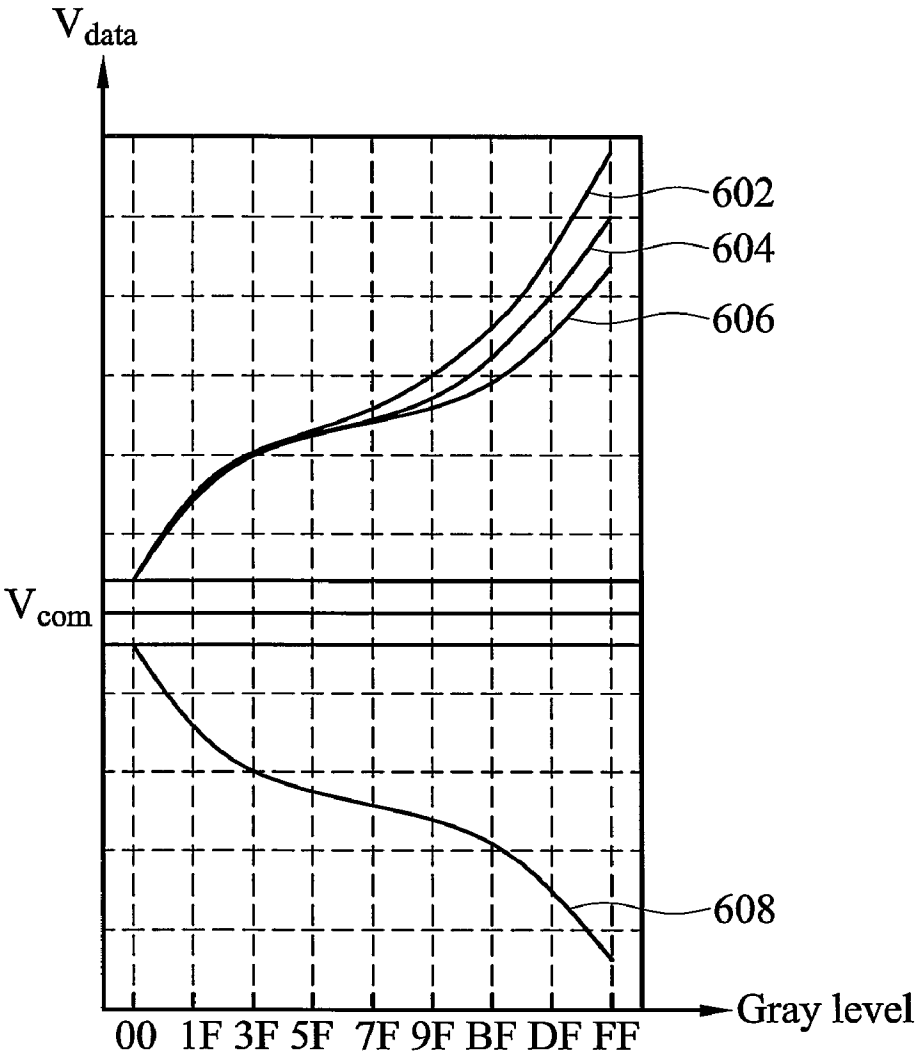
FIG. 6 shows the relationship between the data voltage $V_{data}$ and the gray level, wherein the monitor is driven by techniques disclosed in the invention.

FIG. 6 shows the relationship between the data voltage $V_{data}$ and the gray level, wherein the monitor is driven by techniques disclosed in the invention. Curves 606 and 608 are generated by the ideal gamma curve. When the polarity of the pixel is positive ($V_{data}$ and $V_{pixel}$ are both greater than $V_{com}$), the $V_{data}$—gray level relationship is shown by curve 606. When the polarity of the pixel is negative ($V_{data}$ and $V_{pixel}$ are both lower than $V_{com}$), the $V_{data}$—gray level relationship is shown by curve 608. In some embodiments, the ideal gamma curve is the same as the gamma curve adopted in conventional driving methods. In some special cases, the electrical characteristics of a pixel are dependent on the polarity of the pixel. In such cases, the invention provides two distinct ideal gamma curves for the positive polarity condition and the negative polarity condition.

When the polarity change of the pixel is from negative to positive, the first compensated gamma curve is adopted to generate the first compensated data voltage. Curve 602 shows the relationship between the first compensated data voltage and the gray level. When no polarity change occurs in the pixel and the pixel is maintained at positive polarity, the second compensated gamma curve is adopted to generate the second compensated data voltage. Curve 604 shows the relationship between the second compensated data voltage and the gray level. In some embodiments, the compensated gamma curves adopted when the polarity change of the pixel is from positive to negative or is maintained at negative polarity are the same as the ideal gamma curve adopted when the polarity of the pixel is negative. In such cases, the relationship between the compensated data voltage and the gray level is the same as that shown by curve 608.

Figure 7:
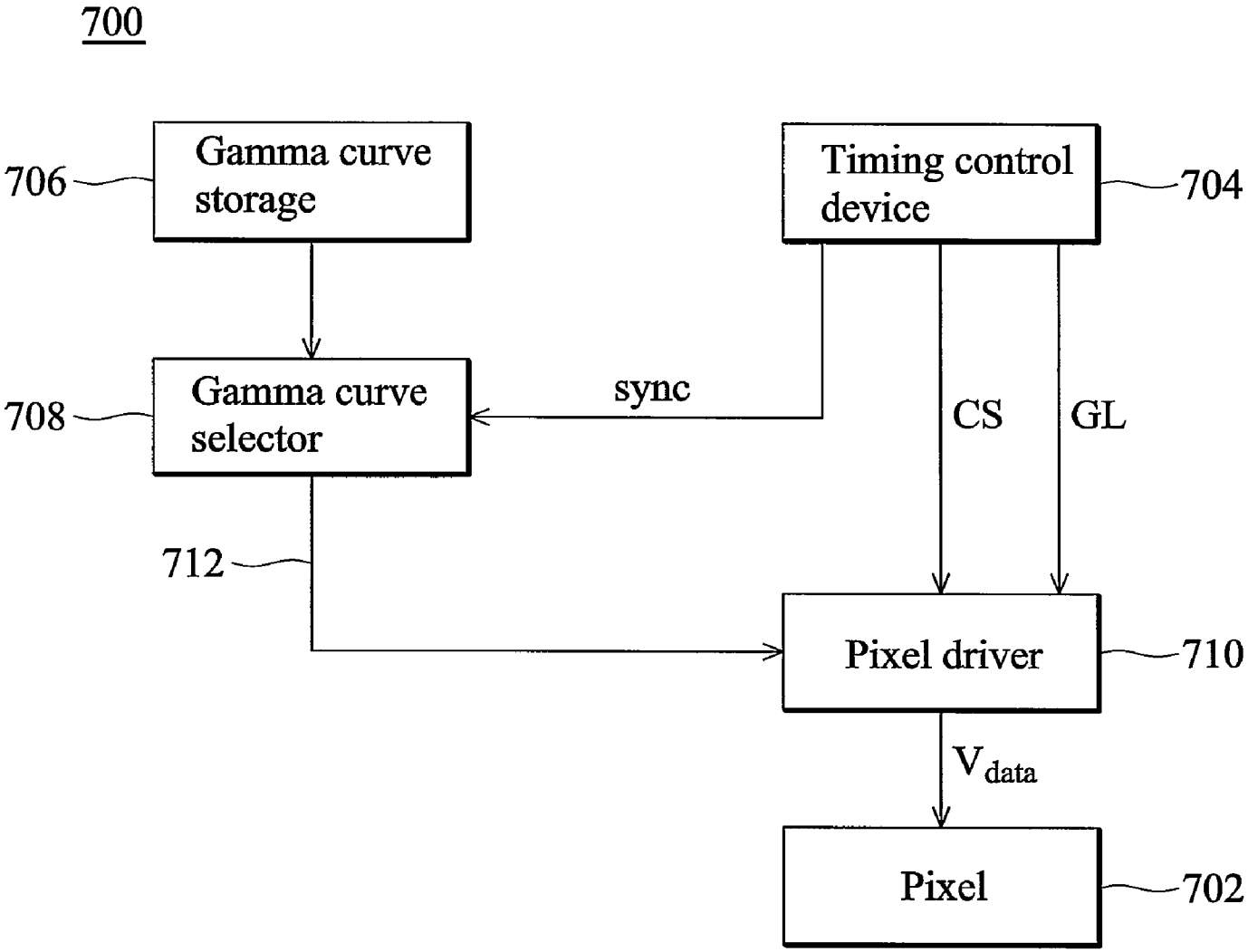
FIG. 7 shows the block diagram of a liquid crystal display panel of the invention.

FIG. 7 shows the block diagram of a liquid crystal display panel of the invention. The liquid crystal display panel 700 comprises a pixel 702, a timing control device 704, a gamma curve storage 706, a gamma curve selector 708, and a pixel driver 710. The timing control device 704 generates a synchronous signal (sync), a control signal (CS), and a gray level for driving the pixel (GL). In some embodiments, the gamma curve storage 706 may be implemented by a gamma curve chip or a gamma resistor. The gamma curve storage 706 comprises an ideal gamma curve and at least one compensated gamma curve. Based on the synchronous signal (sync), the gamma curve selector 708 selects one compensated gamma curve from the gamma curve storage 706 during a first charging time segment according to a polarity change of the pixel, and selects the ideal gamma curve from the gamma curve storage 706 during the second charging time segment. According to the selected gamma curve 712, the control signal CS, and the gray level of the pixel GL, the pixel driver 710 generates a data voltage $V_{data}$ to charge the pixel 702. In some embodiments, a data voltage corresponding to a maximum gray level and generated by a ideal gamma curve is not equal to a data voltage corresponding to the maximum gray level and generated by the selected compensated gamma curve.

In some embodiments, the gamma curve storage comprises more than one compensated gamma curves comprising a first compensated gamma curve and a second compensated gamma curve. Gamma curve selector 708 selects the first compensated gamma curve when the polarity change of the pixel is from negative to positive. The second compensated gamma curve is selected by the gamma curve selector 708 when no polarity change occurs in the pixel and the pixel is maintained at positive polarity. When the polarity of the pixel is positive, a first data voltage corresponding to a gray level and generated by the first compensated gamma curve is greater than a second data voltage corresponding to the gray level and generated by the second compensated gamma curve, and the second data voltage is greater than a third data voltage corresponding to the gray level and generated by the ideal gamma curve.

In some special cases, instances of insufficient charge/discharge in a pixel maintained at positive polarity are as severe as in a pixel having a polarity change from negative to positive. In such cases, the second gamma curve applied to generate a compensated data voltage for the pixel maintained at positive polarity is the same as the first gamma curve applied to generate a compensated data voltage for the pixel having a polarity change from negative to positive polarity.

In mentioned some cases, there are no instances of insufficient charge/discharge when the polarity of the pixel is negative (including the polarity change is from positive to negative and a pixel maintained at negative polarity). In such cases, when the polarity of the pixel is negative, the compensated data voltage driving the pixel during the first charging time segment is typically the same as the ideal data voltage driving the pixel during the second charging time segment. In some special cases, however, instances of insufficient charge/discharge still occur even though the polarity of the pixel is negative. In such cases, the invention provides individually designed compensated gamma curves for the pixel having a polarity change from positive to negative and pixels in which the polarity is always negative.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded to the broadest interpretation so as to encompass all such modifications and similar arrangements.

What is claimed is:

1. A method of driving a pixel, comprising:

generating a compensated data voltage for the pixel based on a gray level of the pixel and a polarity change of the pixel;

generating an ideal data voltage for the pixel based on the gray level, wherein the ideal data voltage is of the same polarity as the compensated data voltage, and the ideal data voltage is generated according to an ideal gamma curve;

dividing a charging period for one sub-frame of the pixel into a first charging time segment and a second charging time segment, wherein the first charging time segment is prior to the second charging time segment;

charging the pixel by the compensated data voltage during the first charging time segment; and charging the pixel by the ideal data voltage during the second charging time segment;

wherein the compensated data voltage is generated according to a first compensated gamma curve when the polarity change of the pixel is from negative to positive, and the compensated data voltage is generated according to a second compensated gamma curve when no polarity change occurs in the pixel and the polarity of the pixel is positive.

2. The method as claimed in claim 1, wherein maximum data voltages generated by the ideal gamma curve and the first compensated gamma curve are unequal.

3. The method as claimed in claim 1, wherein when the polarity of the pixel is positive, a first data voltage corresponding to the gray level and generated according to the first compensated gamma curve is greater than a second data voltage corresponding to the gray level and generated according to the second compensated gamma curve, and the second data voltage level is greater than a third data voltage corresponding to the gray level and generated according to the ideal gamma curve.

4. The method as claimed in claim 3, wherein the compensated data voltage is generated according to the ideal gamma curve when the polarity change of the pixel is from positive to negative or maintained at negative polarity.

5. The method as claimed in claim 1, wherein the compensated data voltage is generated according to the first compensated gamma curve when no polarity change occurs in the pixel and the polarity of the pixel is positive.

6. The method as claimed in claim 5, wherein when the polarity of the pixel is positive, a first data voltage corresponding to the gray level and generated according to the first compensated gamma curve is greater than a second data voltage corresponding to the gray level and generated according to the ideal gamma curve.

7. The method as claimed in claim 6, wherein the compensated data voltage is generated according to the ideal gamma curve when the polarity change of the pixel is from positive to negative or the polarity of the pixel is maintained at negative polarity.

8. The method as claimed in claim 1, wherein the compensated data voltage is generated according to a first compensated gamma curve when the polarity change of the pixel is from positive to negative.

9. The method as claimed in claim 8, wherein the compensated data voltage is generated according to a second compensated gamma curve when no polarity change occurs in the pixel and the polarity of the pixel is negative.

10. The method as claimed in claim 9, wherein when the polarity of the pixel is negative, a first data voltage corresponding to the gray level and generated according to the first compensated gamma curve is smaller than a second data voltage corresponding to the gray level and generated according to the second compensated gamma curve, and the second data voltage level is smaller than a third data voltage corresponding to the gray level and generated according to the ideal gamma curve.

11. A liquid crystal display panel, comprising:

a pixel;

a timing control device, outputting a synchronous signal, a control signal, and a gray level for the pixel;

a gamma curve storage, comprising an ideal gamma curve, and at least one compensated gamma curve;

a gamma curve selector, receiving the synchronous signal, selecting one appropriate compensated gamma curve from the gamma curve storage during a first charging time segment according to a polarity change of the pixel, and selecting the ideal gamma curve from the gamma curve storage during a second charging time segment, wherein the first and second charging time segments form a charging period for one sub-frame of the pixel and the first charging time segment is prior to the second charging time segment; and a pixel driver, generating a data voltage to charge the pixel a compensated data voltage during the first charging time segment and an ideal data voltage during the second charging time segment to charge the pixel, wherein the generation of the compensated data voltage and the ideal data voltage is based on the gamma curves selected by the gamma curve selector, the control signal, and the gray level of the pixel, and the ideal data voltage is of the same polarity as the compensated data voltage wherein the gamma curve storage stores a first compensated gamma curve as said compensated gamma curve, and the first compensated gamma curve is selected by the gamma curve selector as the appropriate compensated gamma curve when the polarity change is from negative to positive polarity, and the gamma curve storage further stores a second compensated gamma curve as another said compensated gamma curve, and the second compensated gamma curve is selected by the gamma curve selector as the appropriate compensated gamma curve when no polarity change occurs and the polarity of the pixel is positive.

12. The method as claimed in claim 11, wherein maximum data voltages generated by the ideal gamma curve and the compensated gamma curve are unequal.

13. The method as claimed in claim 11, wherein when the polarity of the pixel is positive, a first data voltage corresponding to the gray level and generated according to the first compensated gamma curve is greater than a second data voltage corresponding to the gray level and generated according to the second compensated gamma curve, and the second data voltage is greater than a third data voltage corresponding to the gray level and generated according to the ideal gamma curve.

14. The liquid crystal display panel as claimed in claim 13, wherein the selected appropriate compensated gamma curve is identical to the ideal gamma curve when the polarity change is from positive to negative polarity or maintained at negative polarity.

15. The liquid crystal display panel as claimed in claim 11, wherein the selected appropriate compensated gamma curve is the first compensated gamma curve when no polarity change occurs and the polarity of the pixel is positive.

16. The liquid crystal display panel as claimed in claim 15 wherein, when the polarity of the pixel is positive, a first data voltage corresponding to the gray level and generated by the first compensated gamma curve is greater than a second data voltage corresponding to the gray level and generated by the ideal gamma curve.

17. The liquid crystal display panel as claimed in claim 16, wherein the selected appropriate compensated gamma curve is identical to the ideal gamma curve when the polarity change of the pixel is from positive to negative or maintained at negative polarity.

18. The method as claimed in claim 11, wherein the gamma curve storage stores a first compensated gamma curve as said compensated gamma curve, and the first compensated gamma curve is selected by the gamma curve selector as the appropriate compensated gamma curve the compensated data voltage is generated according to a first compensated gamma curve when the polarity change of the pixel is from positive to negative.

19. The method as claimed in claim 18, wherein the gamma curve storage further stores a second compensated gamma curve as another said compensated gamma curve, and the second compensated gamma curve is selected by the gamma curve selector as the appropriate compensated gamma curve the compensated data voltage is generated according to a second compensated gamma curve when no polarity change occurs in the pixel and the polarity of the pixel is negative.

20. The method as claimed in claim 19, wherein when the polarity of the pixel is negative, a first data voltage corresponding to the gray level and generated according to the first compensated gamma curve is smaller than a second data voltage corresponding to the gray level and generated according to the second compensated gamma curve, and the second data voltage level is smaller than a third data voltage corresponding to the gray level and generated according to the ideal gamma curve.

21. The liquid crystal display panel as claimed in claim 11, wherein the gamma curve storage is implemented by a gamma curve chip or a gamma resistor.

* * * * *